United States Patent [19]

Slosek

[11] 4,067,065

[45] Jan. 10, 1978

[54] CHEMICAL SPLASH SHIELD

[75] Inventor: Patrick F. Slosek, Dudley, Mass.

[73] Assignee: American Optical Corporation, Southbridge, Mass.

[21] Appl. No.: 748,804

[22] Filed: Dec. 8, 1976

[51] Int. Cl.[2] ..... A61F 9/00

[52] U.S. Cl. ..... 2/10

[58] Field of Search ..... 2/9, 8, 7, 6, 10; 220/375; 215/306; 24/73 GS, 208 A

[56] References Cited

U.S. PATENT DOCUMENTS

| | | | |
|---|---|---|---|
| 2,610,323 | 9/1952 | Johnson | 2/8 |
| 2,704,100 | 3/1955 | Freeman | 220/375 |
| 3,210,820 | 10/1965 | Humiston | 24/208 A |
| 3,543,763 | 12/1970 | Porco | 24/73 GS |
| 3,729,780 | 5/1973 | White | 24/208 A |

*Primary Examiner*—Doris L. Troutman

*Attorney, Agent, or Firm*—Howard R. Berkenstock, Jr.

[57] ABSTRACT

A faceshield constructed and arranged to protect against chemical splash and other ambient foreign matter. A main support pivotally attachable to a safety cap carries a depending transparent facepiece detachably connected to the main support beneath an overhang. The connection is made with buttons suspended from the overhang and the overhang, in turn, shields the facepiece connection from direct exposure to splash. Provision for snap-fitting the main support to the safety cap brim avoids accidental displacement of the shield during use while permitting its release and selective pivoting to an out-of-the-way position.

4 Claims, 3 Drawing Figures

CHEMICAL SPLASH SHIELD

BACKGROUND OF THE INVENTION

1. Field of the Invention:

Faceshields with particular reference to a type adaptable to safety caps.

2. Discussion of the Prior Art:

Faceshields worn with safety headgear for protection against chemical splash and other foreign matter are traditionally cumbersome and costly to use particularly in situations where excessive splash or spattering requires frequent replacement of the transparent facepiece.

The heretofore requirement for clips, snap-fastening elements and the like on disposable facepiece components renders their materials and manufacturing costs unduly high and contrary to industry's long-standing need for greater economy in single use or otherwise disposable facepieces. Prior art approaches to cost reduction which suggest the use of reusable facepiece fasteners of collar button types for example, lead only to time-consuming uneconomical individual handling of fasteners during removal from spent facepieces and their reinsertion in replacement facepieces. Lost and damaged or defective fasteners together with the tediousness and ungainliness of the operation have rendered this approach generally less than worthwhile.

In addition to the outstanding need for improvement in facepiece fastening mechanics, there is a somewhat corresponding need for greater effectiveness in deflection of splash away from the area of facepiece-to-main body attachment in the subject devices.

With consideration of the foregoing and related matters, it is a principal object of the present invention to provide splash shields which afford greater personal protection at less than usual cost, comprise a minimum of component parts and are simply and quickly disassembled and reassembled for replacement of spent faceshield components.

It is a more specific object to provide simple and efficient faceshield fastening mechanisms for splash guard devices which are free of loose components and whose faceshields per se are without ancilliary fastening devices thereby rendering their cost of manufacture minimal and disposal after single or short-term use readily economically feasible.

Other objects and advantages of the invention will become apparent from the following description.

SUMMARY OF THE INVENTION

The aforesaid objects and their corollaries are accomplished according to the invention by the provision of a faceshield having a main support which may be pivotally attached to a safety cap and which carries a depending transparent facepiece detachably connected to the main support beneath an overhang. The connection is made with buttons which are permanently suspended from the overhang of the main support by integral thread-like extensions of the material of the main support. The overhang of the main support in turn shields the facepiece connection from direct exposure to splash, spatter and other ambient foreign matter.

The facepiece main support is additionally provided with means for snap-fitting to the safety cap rim for avoidance of accidental displacement of the shield during use while permitting its release from the cap rim and selected pivoting of the complete faceshield unit to an out-of-the-way position.

Details of the invention will become more readily apparent from the following description when taken in conjunction with the accompanying drawings.

DESCRIPTION OF THE PREFERRED EMBODIMENTS

Referring more particularly to the drawings, faceshield 10 of the invention comprises a main supporting body 12 to which is detachably connected beneath overhang 14 a depending facepiece 16. Main body 12 is preferably cast or molded of a durable plastic material having in thin sections a relatively high degree of flexibility and in all thicknesses and forms a high resistance to weathering and deterioration or other damage by ordinary chemical exposure and/or attack. Polypropylene, polyethylene or polyisobutylene are suitable materials. Facepiece 16 may be formed of an inexpensive clear or colored, preferably substantially stress and strain-free, sheet material such as a single thickness or multiple layer structure of molded or otherwise formed polycarbonate or acetate, for example. Other customarily used faceshield materials may, of course, be used.

Figure 3:
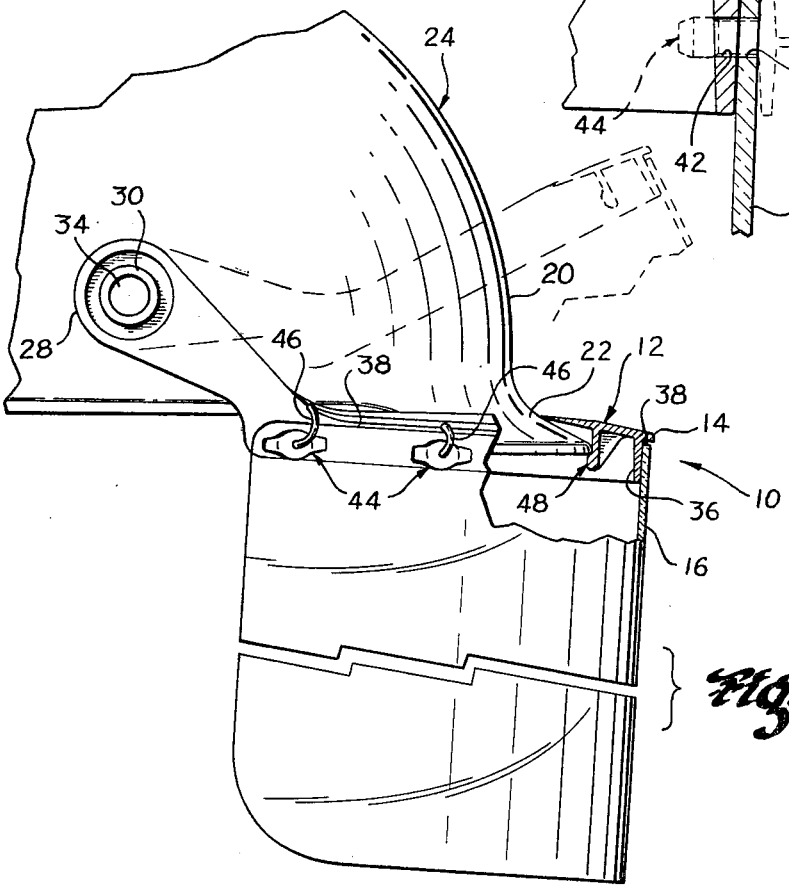
FIG. 3 depicts the faceshield partially in cross-section and as applied to a safety cap for use according to the invention.

Constructionally, main body 12 is generally semi-circular in shape with an inner edge portion 18 (FIG. 1) contoured so as to relatively intimately follow and fit the juncture between crown portion 20 and brim 22 of a safety cap to which the faceshield 10 of the invention is intended to be applied, e.g. as illustrated in FIG. 3.

Main body 12 terminates at opposite ends 26 and 28 with sockets 30 and 32 respectively which may be pivotally connected to safety cap 24 in any manner desired by the artisan, e.g. simply with studs 34 or with detachable slide connectors (not shown), none of which require detailed description herein. It is contemplated that any conventional pivotal connection and/or connecting means may be used. This portion of the main body 12 is not per se of special pertinence to the present invention.

Figure 1:
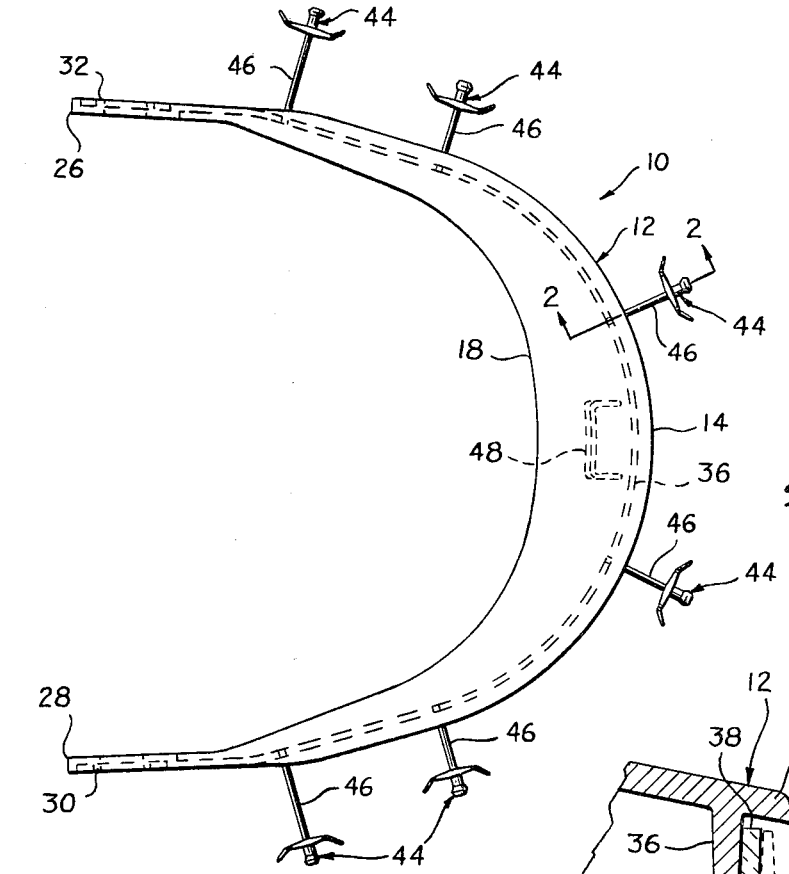
FIG. 1 is a plan view of a preferred embodiment of the invention.

In relating more particularly to the crux of the present invention, main body 12 is provided with a generally semi-circular depending facepiece mounting flange 36 which, in set back relationship with overhang 14 (FIGS. 2 and 3) is adapted to receive facepiece 16 with its upper most edge 38 placed adjacent to the juncture of flange 36 and overhang 14. This affords optimum protection against ambient splash and/or spatter during use of the faceshield device 10. Facepiece 16 and flange 36 are provided with matching openings 40 and 42 respectively, (FIG. 2) at preselected spaced locations about their semi-circular extensions as best shown in FIGS. 1 and 3.

Figure 2:
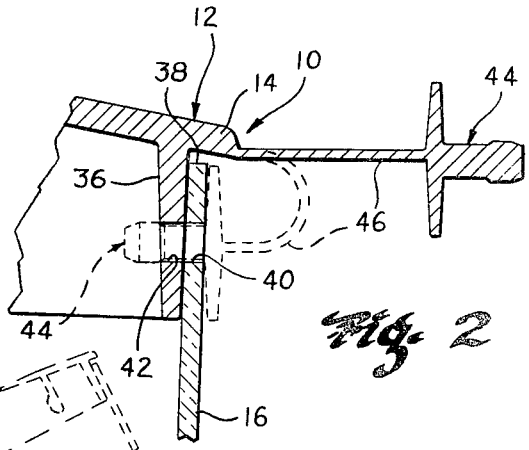
FIG. 2 is an enlarged fragmentary cross-sectional view taken along line 2—2 of FIG. 1.

Adjacent each of openings 42 in flange 36 there is suspended from the leading edge of overhang 14 a button 44 adapted to be snap-fitted through openings 40 and 42 substantially as illustrated with broken lines in FIG. 2 and full lines in FIG. 3. Detachment and replacement of facepiece 16 merely requires thumb and finger withdrawal of buttons 44 and their replacement in holes 40 of another similar facepiece when the latter is positioned against flange 36 with its holes substantially aligned with holes 42 in the flange 36.

Integral thread-like extensions or sprigs 46 between buttons 44 and overhang 14 of main body 12 prevent loss or displacement of these buttons and maintain the same in readily available juxtaposition to their intended position of use during the operation of removing and replacing facepiece 16. It is contemplated that buttons 44 and sprigs 46 be formed simultaneously and integral with overhang 14 and the remaining portions of main body 12, e.g. in a single molding or casting operation.

At a position substantially midway of the semi-circular configuration of main body 12, resilient latch 48 extends downwardly and generally parallel to flange 36 (FIG. 3). By such means, the main body of faceshield 10 may be releasably snap-fitted over brim 22 of safety cap 24 to fix its facepiece 16 in a position of use when the cap is worn. A swinging of the entire unit of faceshield 10 pivotally upwardly to a temporary out-of-the-way position as depicted with dot-dash outline may alternatively be effected simply by applying a lifting force sufficient to cause latch 48 to ride over the edge of brim 22.

It should be noted that facepiece 16 per se requires no ancillary fastening components whatever and thus may be inexpensively cast, cut and/or punched from a preselected suitable optically clear material, examples of which have been mentioned hereinabove. Facepiece 16 is merely perforated (i.e. provided with openings 40) adjacent its uppermost edge.

It should be apparent that faceshield 10 is contemplated as being rendered adaptable to forms and types of safety caps and helmets different than the one herein illustrated. The drawings are merely illustrative and it will be appreciated by those skilled in the art that various modifications and adaptations of the precise forms of the invention here shown may be made to suit particular requirements within the scope of the following claims.

I claim:

1. A safety shield comprising:

a main body member having an overall generally semi-circular configuration with a depending facepiece mounting flange and peripheral overhang;

a transparent facepiece detachably connected to said flange beneath said overhang;

said flange and facepiece having a succession of matched openings and at each sequent a button extending therethrough for providing said detachable connection;

a flexible sprig extending from each of said buttons to said main body member, said main body member, sprigs and buttons being a one-piece molded plastic unit.

2. A safety shield according to claim 1 wherein said flexible sprigs comprise extensions of said peripheral overhang.

3. A safety shield according to claim 1 wherein the molded plastic unit of said main body member, sprigs and buttons further includes a depending resilient latch component extending generally parallel to said facepiece mounting flange.

4. A safety shield according to claim 1 wherein opposite ends of said generally semi-circular main body member are provided with pivot sockets and said member is therewith pivotally attachable to a safety cap having junctioned crown and brim portions, said main body member being extendable semi-circularly about at least a portion of said crown and brim junction with said facepiece mounting flange spaced away from said cap brim;

said main body member being further provided with a resilient latch component depending in generally parallel relationship with said flange and into engagement with said cap brim when said main body member is extended about said crown and brim junction thereby preventing accidental displacement of said safety shield from a latched position yet permitting release with a moderate lifting force applied to said main body member.

* * * * *